United States Patent [19]

Hsieh

[11] Patent Number: 4,635,021

[45] Date of Patent: Jan. 6, 1987

[54] AUTOMATIC OVERLOAD TRIPPER

[76] Inventor: Teng-Jui Hsieh, No. 16, Lane 136, Hsin Shu Rd., Hsin Chuang, Taiwan

[21] Appl. No.: 744,735

[22] Filed: Jun. 14, 1985

[51] Int. Cl.[4] ..... H01H 71/04; H01H 71/16

[52] U.S. Cl. ..... 337/76; 337/79

[58] Field of Search ..... 337/79, 66, 67, 70, 337/72, 75, 76, 85, 91, 113

[56] References Cited

U.S. PATENT DOCUMENTS 2,458,804 1/1949 Sundt ..... 337/76

3,038,047 6/1962 Marquis ..... 337/76

4,342,979 8/1982 Phillips ..... 337/79

*Primary Examiner*—Harold Broome

*Attorney, Agent, or Firm*—Lane and Aitken

[57] ABSTRACT

An automatic overload tripper which uses a push button to press a bent bimetal strip down against a spring which assures that a hook at an end of the bimetal strip can keep good electrical contact with a contact plate, and the hook can trip automatically at overload. The spring also pushes against the bimetal strip so that it will not restore its original position by itself after cooling, for safety purposes.

16 Claims, 7 Drawing Figures

AUTOMATIC OVERLOAD TRIPPER

BACKGROUND OF THE INVENTION

The present invention provides an automatic overload tripper, particularly an overload protection device to be used on electronic products and electrical appliances to replace the conventional fuse and expensive circuit breaker.

The conventional fuse is used as an overload protection device for electrical appliances since it can cut off power supply at overload. However, it is quite inconvenient to replace a burnt fuse. Therefore, generally, a fuseless circuit breaker is installed at the main power switch to avoid frequent replacement of fuses and to act as an overload protection device. Since a circuit breaker is usually large in size and expensive in cost, it can't fully replace the conventional fuse. Though a small automatic breaker has been developed, its size is still not small enough and, since its price is high, it is not suitable for low-priced or small electrical appliances. A newly-developed tripper for use on motorcycles which is said to be an overload protection device does not provide satisfactory protection during short circuit or circuit overload conditions but, rather, burns wire and other electric hardware. The inventor has devoted himself to research and development of overload tripper devices for years. The present invention in his achievement after repeated failure and hundreds of tests. Its size has been minimized and its cost has been minimized too. The present invention has proven to be a reliable and economic automatic overload tripper.

SUMMARY OF THE INVENTION

Disclosed herein is an automatic overload tripper comprising a main body having first and second terminals thereon, a bimetal strip having one end connected with the first terminal and the other end bent downward at a 90° angle, a contact plate attached to the second terminal, a hook at an end of the bimetal strip shaped to hold the contact plate for maintaining conductivity and to trip automatically at overload, a spring to push the hook upward so that it will not return its original position after cooling and a push button adapted for applying downward pressure to the spring until the hook on the bimetal strip holds the contact plate again.

DESCRIPTION OF THE PREFERRED EMBODIMENT

Figure 1:
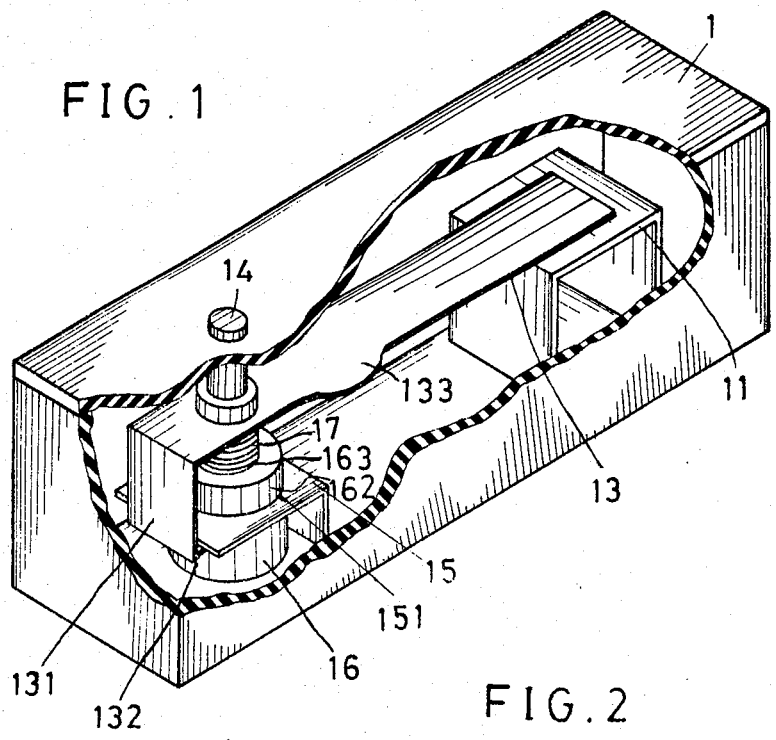
FIG. 1 is a perspective view of a preferred embodiment of the present invention.
Figure 2:
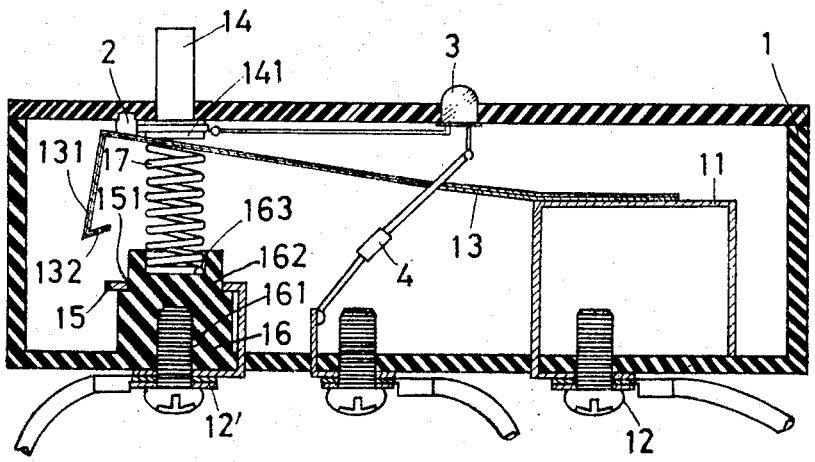
FIG. 2 is a perspective view of another preferred embodiment of the present invention with a trouble indicator.

FIG. 1 is a perspective view of a preferred embodiment of the present invention in the normal condition. Within its main body 1 there is a metal frame 11 connecting with a terminal 12 for connecting wiring, as shown in FIG. 2. On the top of the metal frame there is a bimetal strip 13 which has an end turned 90° downwards and a hook 132 at that end. While the bimetal strip 13 is pressed downwards, the hook 132 slides from the top of a contact plate 15 to the bottom of the contact plate 15 and is then held thereat. The contact plate passes through a hole at the bottom of a fixing block 16 and connects with another terminal for wiring 12'. The fixing block 16 has a column 162 on its top that is inserted through a hole 151 in the contact plate 15 to fix it to the column 162. At the center of the column 162 there is a recess 163 containing a spring 17. An end of the spring 17 pushes against the bimetal strip 13 so that the bimetal strip 13 will not return to its position after it is tripped due to overload. The spring 17 keeps the contact plate 15 in close contact with the bimetal strip 13 for maintaining good conductivity while the hook 132 of the bimetal strip 13 is held by the contact plate 15 by holding them together even during strong vibration, but allowing them to trip readily at overload.

The present invention has a push button 14 which is fixed to the main body by a flange 141. When the bimetal strip 13 has to be repositioned after tripping, the push button 14 is pressed to apply pressure on the bimetal strip 13 and the spring 17 until the bimetal strip 13 is held by the contact plate 15 again.

Figure 3:
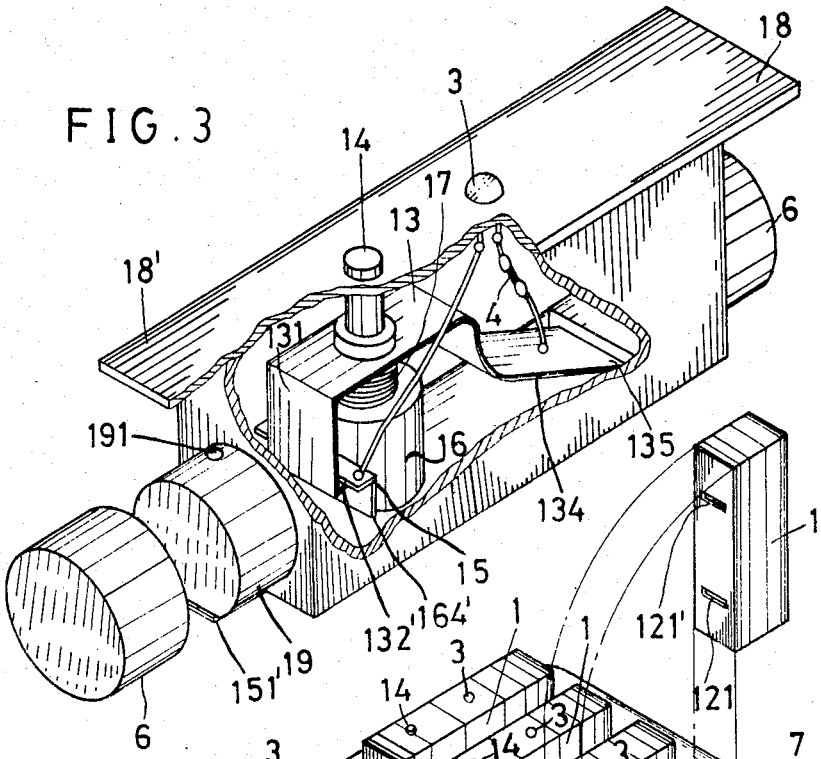
FIG. 3 is a perspective view of another embodiment of the present invention for use in fuse-type installations.

As illustrated at FIG. 1, the bimetal strip 13 has a widened section 133 at a position which provides a powerful tripping motion at overload. Another form of the bimetal strip 13 is shown in FIG. 3. It has a downward-curving portion 134 at a position which also provides powerful tripping movement. One or more small longitudinal grooves may be formed in the bimetal strip 13 to increase tripping force. In order to maintain a good conduction between the bimetal strip 13 and the contact plate, the present invention applies a spring 17 to keep them in close contact. Furthermore, the contact surfaces on the bimetal strip 13 and contact plate 15 are gilt of silver plated, or platinum to prevent oxidization due to heating which may cause contact failure.

FIG. 2 is a perspective view of a preferred embodiment of the present invention with a trouble indicator. Except for the trouble indicator, its structure is substantially similar to that shown in FIG. 1, and therefore, only the trouble indicator will be described below. The bimetal strip 13, after tripping, contacts a block 2, which together with an LED 3 and a resistor 4, connect to a third terminal 12 is series, and the terminal 12 is connected to another line of the power source, so that LED 3 lights as a warning signal after the bimetal strip 13 is tripped.

FIG. 3 is a perspective view of another preferred embodiment for the present invention, a fuse-type package with trouble indicator. Its structure is substantially similar with that illustrated in FIG. 2, except for the differences described below. The LED 3 and resistor 4 are connected between the two terminals 12 and 12'. While the bimetal strip 13 is held by the contact plate 15, the potential across the parallel circuit comprising LED 3 and the resistor 4 is zero and the LED 3 does not light. But after the bimetal strip 13 is tripped, the circuit from the power source, through the load resistor 4, LED 3, contact plate 15 and another line to the power source conducts so that the LED 3 lights as a warning of overload. If the present invention breaks down, if the contact plate 15 fails to hold the bimetal strip 13, the circuit between terminals 12 and 13 will remain open and the LED 3 will provide a warning light.

FIG. 3 is a perspective view of a preferred embodiment for the present invention in a fuse-type package. Cylindrical columns 19 are designed at both ends of the main body 1. The contact plate 15 passes through a hole 164 so that an end of the contact plate 15 extends along the surface of one column 19, and an end of the bimetal strip 13 also extends along the surface of a like column 19. On the surface of the column 19 there are ribs 191 as shown in FIG. 3 so that the column can be firmly covered by cap 6 or 6'. Protective plates 18 and 18' provided at both sides above the columns to prevent shock while inserting the tripper in a fuse holder.

Figure 4:
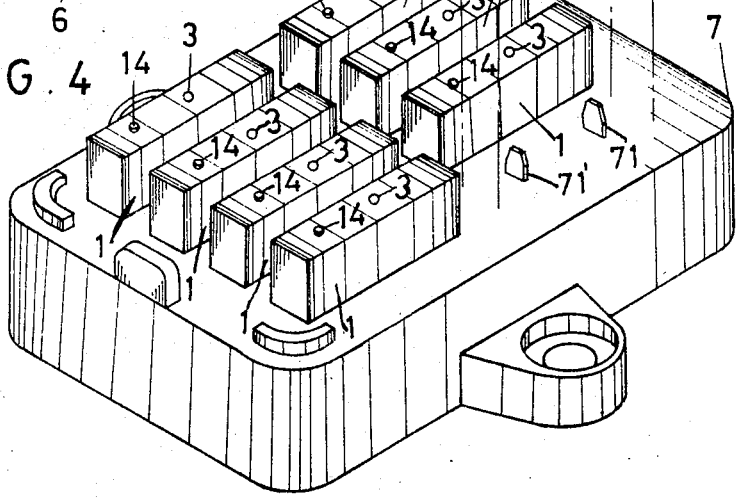
FIG. 4 illustrates structure of a fuse holder for use in an automobile.

FIG. 4 illustrates a fuse-type overload tripper package for use in a car. In such an application, a fuse holder 7 providing pairs of plug tangs 71 and 71' is used. Socket openings 121 and 121' replace the wiring terminals that the plugs 71 and 71' on the fuse holder 7 can be inserted into and fixed to the sockets 121 and 121' respectively. Or, plug tangs may be provided on the overload tripper and corresponding sockets provided on the fuse holder 7.

For use on motorcycles, the overload tripper as disclosed herein can be provided with plug tangs instead of the wiring terminals.

The present invention can be used in any electronic device, electric appliance or socket or switch for automatic tripping and warning at overload.

Figure 5:
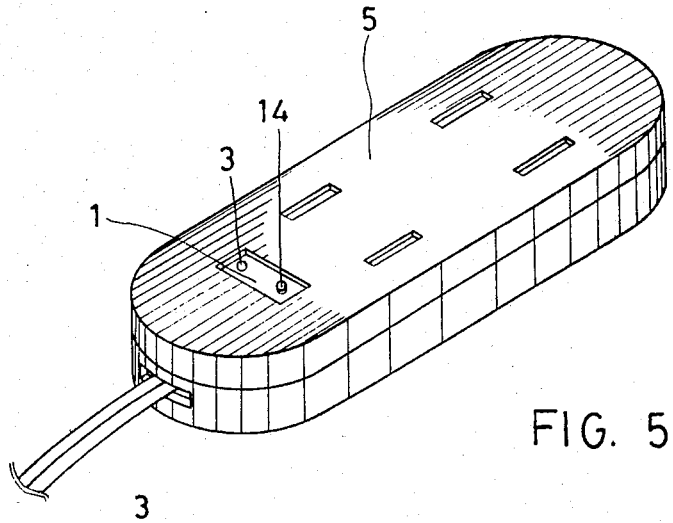
FIG. 5 is a perspective view of a conventional extension cord socket with the present invention.

FIG. 5 shows how it is used in an ordinary power cord socket. The push button 14 and the LED 3 are exposed to make bimetal strip repositioning easy and for indicating overload.

The metal frame 11 as shown in FIG. 1 can be designed to support a bimetal strip 13 in any position higher than that in FIG. 1, or a strip with a downward-curving portion 134 as shown in FIG. 3 either using a lower metal frame or a bimetal strip 13 which is incorporated as part of one of the terminals.

Figure 6:
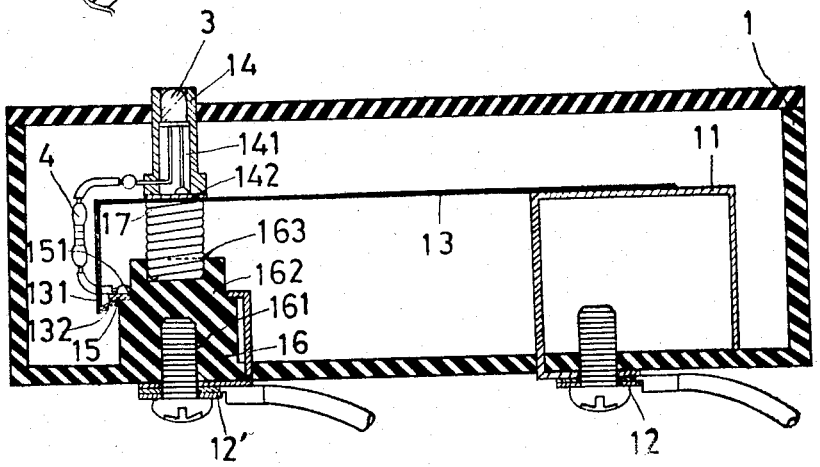
FIG. 6 is a perspective view of a preferred embodiment of the present invention which places an LED on a reset push button.

For convenience purpose, the LED 3 can be placed within a hole 141 in the pushbutton 14 as illustrated in FIG. 6. In FIG. 3, a terminal of the LED 3 is fixed to a metal plate 142 and the other terminal is connected to the resistor 4 and then to the contact plate 15 in series. The LED maintains a circuit through the metal plate 142 after the bimetal strip is tripped, so that the LED 3 lights after such tripping to give a warning signal. Such a design saves space.

The warning device as shown in FIG. 3 and FIG. 6 uses direct current. If alternating current is used, there must be an additional rectifier/filter circuit to light the LED, or the LED used must be adapted for use with alternating current.

The present invention can be designed with socket, pin-plug or plug terminals, to meet any need. The terminals 12 and 12' can be located either on the bottom or the sides of the main body 1.

The present invention can be constructed with or without an indicator in any shape to meet market needs.

Figure 7:
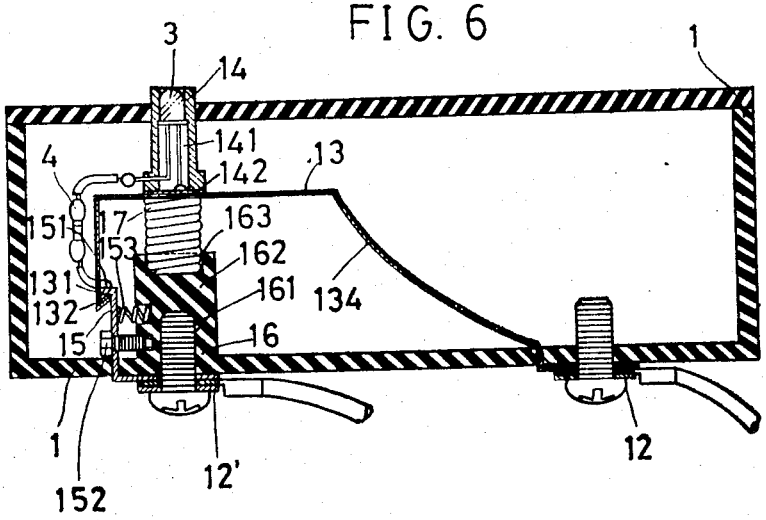
FIG. 7 is a sectional view of a preferred embodiment of the present invention with a large current capacity.

FIG. 7 shows an embodiment of the present invention for use with high currents. Its structure is substantially similar to that shown in FIG. 6. Since the bimetal strip 13 must have additional thickness to provide larger current-carrying capacity, and the hook 132 of the bimetal strip 13 does not readily slide to the underside of the contact plate when pressure is applied to it through the push button 14, this embodiment of the present invention uses a contact plate **15*a* which is flexibly fixed to the main body so that the contact plate 15*a* will move backwards while the hook 132 of the bimetal strip 13 is pressed. Thus, the hook 132 can be slid to the underside of the contact plate 15*a* smoothly. Since large current will cause a great variation on action of the bimetal strip 13, and the contact plate 15*a* is slightly moveable, a screw 152 is used to adjust the position of the contact surface between the contact plate 15*a* and hook 132. The contact plate 15*a* also has a spring 153 behind it so that the contact plate can move backwards against the spring 53 when it is pressed, and the screw 152 restricts the forward movement of the contact plate 15*a* so that the bimetal strip 13** can trip readily when overload conditions occur.

I claim:

1. An automatic overload tripper comprising:

a main body having first and second terminals;

a bimetal strip electrically connected to said first terminal at a first end and having a 90° angle bend turning said bimetal strip downward on a second end thereof opposite said first end, said second end having a hook portion thereof turning upward at the tip of said second end;

a contact plate electrically connected to said second terminal at a first end and having a second end opposite said first end and substantially normal to said downward turning portion of said bimetal strip, the underside of said second end being adapted to engage said hook portion of said bimetal strip;

a spring in contact with a fixing block on said main body and with said portion of said bimetal strip near said 90° bend so as to bias said hook portion of said bimetal strip upward; and a push button operatively connected with said bimetal strip to press said bimetal strip against said contact and having a surface thereof exposed on the surface of said main body.

2. An automatic overload tripper as claimed in claim 1 wherein the bimetal strip has a widened section and grooves shaped to increase tripping force.

3. An automatic overload tripper as claimed in claim 1 wherein the bimetal strip has a downward-curved portion between said first end and said 90° bend, said downward-curved portion being shaped to increase tripping force.

4. An automatic overload tripper as claimed in claim 1 wherein the contact surfaces on said bimetal strip and said contact plate are gilt or silver-plated, or platinum to achieve the best contact.

5. An automatic overload tripper as claimed in claim 1 wherein the two terminals for wiring are located at both ends in the form of cylindrical columns shaped to be held by fuse holder.

6. An automatic overload tripper as claimed in claim 5 wherein protection plates are provided above the two terminals to prevent shock.

7. An automatic overload tripper as claimed in claim 1 wherein the terminals are socket-type terminals, plug type of pin type.

8. An automatic overload tripper as claimed in claim 1 further comprises an LED, said LED being connected in series with a resistor, a third terminal for providing power to the LED, and a block that makes electrical contact with said bimetal strip when the bimetal strip is tripped so that the LED lights to give a warning signal after the bimetal strip is tripped.

9. An automatic overload tripper as claimed in claim 1 wherein the indicator device is an LED and a resistor connected in series with said first and second terminals so that the LED lights to give a warning signal after the bimetal strip is tripped.

10. An automatic overload tripper as claimed in claim 1 further comprising an indicator device connected to said bimetal strip to indicate when said bimetal strip is tripped, thereby providing a trouble indication.

11. An automatic overload tripper as claimed in claim 1 wherein said fixing block has a column on which said contact is fixed and a recess on said column for holding said spring.

12. An automatic overload tripper as claimed in claim 1 shaped for use in place of a fuse.

13. An automatic overload tripper as claimed in claim 1 wherein said terminals are two cylindrical ribbed columns along which said first end of the bimetal strip and said first end of the contact extend, respectively, and over which metal caps are firmly mounted thereby permitting use of the tripper in lieu of a cartridge fuse.

14. An automatic overload tripper as claimed in claim 1 further comprising an LED located within a hole on the push button, and a metal plate below the push button that is electrically connected and maintains contact with the LED so that the LED lights after the bimetal strip is tripped.

15. An automatic overload tripper as claimed in claim 1 wherein the contact plate is affixed to the main body and further comprising a spring that urges said contact plate so that the contact plate can move backwards when it is pressed by said hook, and means for adjusting the contact between the contact plate and the bimetal strip and restricting the forward movement of the contact plate toward said bimetal strip so that the bimetal strip can trip automatically at overload.

16. An automatic overload tripper as claimed in claim 1 wherein said hook is V-shaped and forms an acute angle with said bent portion along an axis intersecting a portion of said bimetal strip located between said first terminal and said 90° angle bend.

* * * * *